US008597053B2

(12) United States Patent
Oh

(10) Patent No.: US 8,597,053 B2
(45) Date of Patent: Dec. 3, 2013

(54) ELECTRICAL CONNECTOR FOR TERMINATING A CABLE

(75) Inventor: Lawrence Se-Jun Oh, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 97 days.

(21) Appl. No.: 13/232,768

(22) Filed: Sep. 14, 2011

(65) Prior Publication Data

US 2012/0258624 A1 Oct. 11, 2012

Related U.S. Application Data

(63) Continuation-in-part of application No. 13/080,477, filed on Apr. 5, 2011.

(51) Int. Cl.
*H01R 13/648* (2006.01)

(52) U.S. Cl.
USPC ..... 439/607.41

(58) Field of Classification Search
USPC ..... 439/607.41, 607.5, 607.51, 607.52, 439/607.04
See application file for complete search history.

(56) References Cited

U.S. PATENT DOCUMENTS

| | | | | |
|---|---|---|---|---|
| 3,281,756 | A * | 10/1966 | O'Keefe | 439/320 |
| 4,108,527 | A | 8/1978 | Douty et al. | |
| 4,422,706 | A | 12/1983 | Neuhouser | |
| 4,808,128 | A * | 2/1989 | Werth | 439/607.5 |
| 5,831,815 | A | 11/1998 | Miller et al. | |
| 2008/0009173 | A1 | 1/2008 | Carnahan et al. | |

FOREIGN PATENT DOCUMENTS

| | | |
|---|---|---|
| EP | 0 907 221 A2 | 4/1999 |
| WO | WO 97/23926 A1 | 7/1997 |

OTHER PUBLICATIONS

International Search Report, International Application No. PCT/US2012/060486, International Filing Date, Oct. 17, 2012.

* cited by examiner

*Primary Examiner* — Neil Abrams
*Assistant Examiner* — Phuongchi T Nguyen

(57) ABSTRACT

An electrical connector is provided for terminating a cable. The electrical connector includes an electrical contact configured to be terminated to an end of a wire of the cable, and a housing having a dielectric member and an electrically conductive material extending on the dielectric member. The electrical contact is held by the housing. The housing extends from a mating end to a cable end. The housing is configured to mate with a mating connector at the mating end. The cable end includes a shield fitting that is configured to hold an end of a shield of the cable such that the electrically conductive material of the housing is engaged with, and electrically connected to, the shield.

18 Claims, 11 Drawing Sheets

ELECTRICAL CONNECTOR FOR TERMINATING A CABLE

CROSS-REFERENCE TO RELATED APPLICATIONS

The present application is a continuation-in-part of and claims priority from U.S. patent application Ser. No. 13/080,477 titled "Radial Clamp", filed Apr. 5, 2011, the complete subject matter of which is hereby expressly incorporated by reference in its entirety.

BACKGROUND OF THE INVENTION

The subject matter herein relates generally to electrical connectors, and more particularly to electrical connectors that terminate cables.

Electrical connectors used to plug a communication cable into an electrical system may include a shell that provides shielding for one or more contacts housed within the shell. The shell is terminated to a shield, such as a cable braid, of the cable that provides shielding for wire(s) in the cable. However, pluggable connectors that are currently used may have certain limitations due to unwanted electromagnetic interference, which harms signal integrity and the performance of the connector. The shielding around the contacts is an important factor in controlling unwanted electromagnetic coupling. The connection between the shell and the shield of the cable is a source of problems with the shielding of the contact and wires. Also, strain relief between the cable and the electrical connector is another problem.

There are known methods of terminating the shield to the shell, however such known methods are not without disadvantages in terms of cost, complexity, relaxing over time, repair/reuse and the like. One known method uses mini-bands that are applied over the shield using an application tool that cinches the band onto the shield. However, the tool used to apply the mini-bands is expensive. Additionally, the mini-bands tend to relax over time making the mini-band ineffective. Furthermore, removal of the mini-bands requires the mini-bands to be cut off, which destroys the mini-band and may cause damage to the cable braid and/or the connector.

Another known method of securing the shield to the shell uses a coil spring band that is wrapped around the shield. The coil spring band may require many wraps to provide the mechanical strength to hold the shield in place, which may make the coil spring band thick. The coil spring also adds to the weight of the connector and the bulk of the connector. Yet another known method of securing the shield to the shell uses a Tinel lock. The Tinel lock uses inductive heating to shrink the ring, and some applications do not allow the tools required for inductive heating the Tinel lock. For example, in aerospace applications, such tools are discouraged due to the flammable substances around aircrafts and equipment, such as fuel, oil, hydraulic fluids and the like. Additionally, removal of the Tinel lock requires the lock to be cut off, which destroys the lock and may cause damage to the cable braid and/or the connector.

Accordingly, there is a need for termination methods and means for securing a shield of a cable to a conductive shell of an electrical connector in a cost effective and reliable manner. There is a need for termination methods and means for securing a shield of a cable to a conductive shell of an electrical connector that is reusable and does not damage the shield. There is a need for termination methods and means for securing a shield of a cable to a conductive shell of an electrical connector that provides a uniform termination force over the life of the product.

BRIEF DESCRIPTION OF THE INVENTION

In one embodiment, an electrical connector is provided for terminating a cable. The electrical connector includes an electrical contact configured to be terminated to an end of a wire of the cable, and a housing having a dielectric member and an electrically conductive material extending on the dielectric member. The electrical contact is held by the housing. The housing extends from a mating end to a cable end. The housing is configured to mate with a mating connector at the mating end. The cable end includes a shield fitting that is configured to hold an end of a shield of the cable such that the electrically conductive material of the housing is engaged with, and electrically connected to, the shield.

In another embodiment, an electrical connector includes a cable having a wire and a shield providing electrical shielding around the wire, an electrical contact configured to be terminated to an end of the wire of the cable, and a housing having a dielectric member and an electrically conductive material extending on the dielectric member. The electrical contact is held by the housing. The housing extends from a mating end to a cable end. The housing is configured to mate with a mating connector at the mating end. The cable end includes a shield fitting that holds an end of the shield of the cable such that the shield is engaged with and electrically connected to the electrically conductive material of the housing.

In a further embodiment, an electrical connector is provided for terminating a cable. The electrical connector includes an electrical contact configured to be terminated to an end of a wire of the cable, and a housing having a dielectric member and an electrically conductive material extending on the dielectric member. The electrical contact is held by the housing. The housing extends from a mating end to a cable end. The housing is configured to mate with a mating connector at the mating end. The cable end includes a shield fitting having a base and first and second flanges extending radially outward from the base. The first and second flanges are spaced apart along a length of the shield fitting such that a groove is defined between the first and second flanges. The shield fitting is configured to hold an end of the shield of the cable such that the shield extends over the first flange and into the groove and such that the electrically conductive material of the housing is engaged with, and electrically connected to, the shield. The electrical connector also includes a boot configured to be mounted to the shield fitting such that the boot extends over the end of the shield and over the second flange.

DETAILED DESCRIPTION OF THE INVENTION

Figure 1:
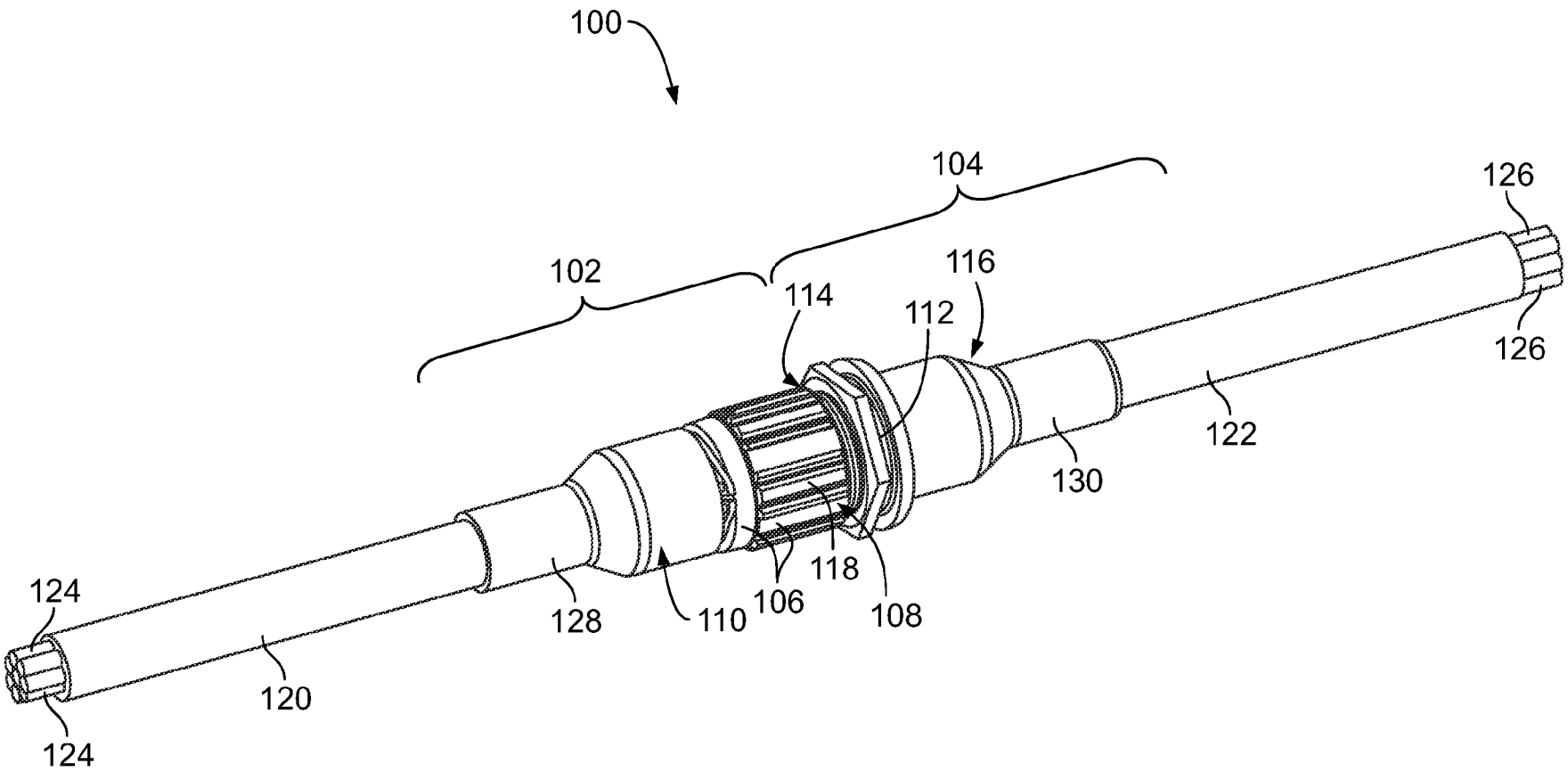
FIG. 1 is a perspective view of a connector system formed in accordance to one embodiment.

FIG. 1 is a perspective view of a connector system 100 according to one embodiment. The connector system 100 includes a female electrical connector 102 and a male electrical connector 104. In the illustrated embodiment, the female and male electrical connectors 102, 104 are shielded RF connectors, however other types of connectors may be used in alternative embodiments. The electrical connectors may be high data rate connectors. The female and male electrical connectors 102, 104 may be adapted for use in military applications, aerospace applications, automotive applications, industrial applications, commercial applications and the like.

The female electrical connector 102 includes a conductive shell 106 extending between a mating end 108 and a cable end 110. The male electrical connector 104 includes a conductive shell 112 extending between a mating end 114 and a cable end 116. The mating ends 108, 114 are connected together and secured together using a lock 118. In the illustrated embodiment, the lock 118 is a threaded collar, however other types of locks may be used in alternative embodiments, such as latches, fasteners and the like.

The female electrical connector 102 is terminated to an end of a cable 120 and the male electrical connector 104 is terminated an end of a cable 122. The cables 120, 122 each include a plurality of wires 124, 126. Any number of wires 124, 126 may be provided. Optionally, the wires 124, 126 may be arranged as twisted wire pairs, where the wires carry differential signals. The wires 124, 126 may be part of a quad cable having multiple wires. A boot 128 is provided over the cable end 110 of the female electrical connector 102 to secure the cable 120 to the shell 106. The boot 128 provides strain relief between the cable 120 and the shell 106. A boot 130 is provided over the cable end 116 of the male electrical connector 104 to secure the cable 122 to the shell 112. The boot 130 provides strain relief between the cable 122 and the shell 112.

Figure 2:
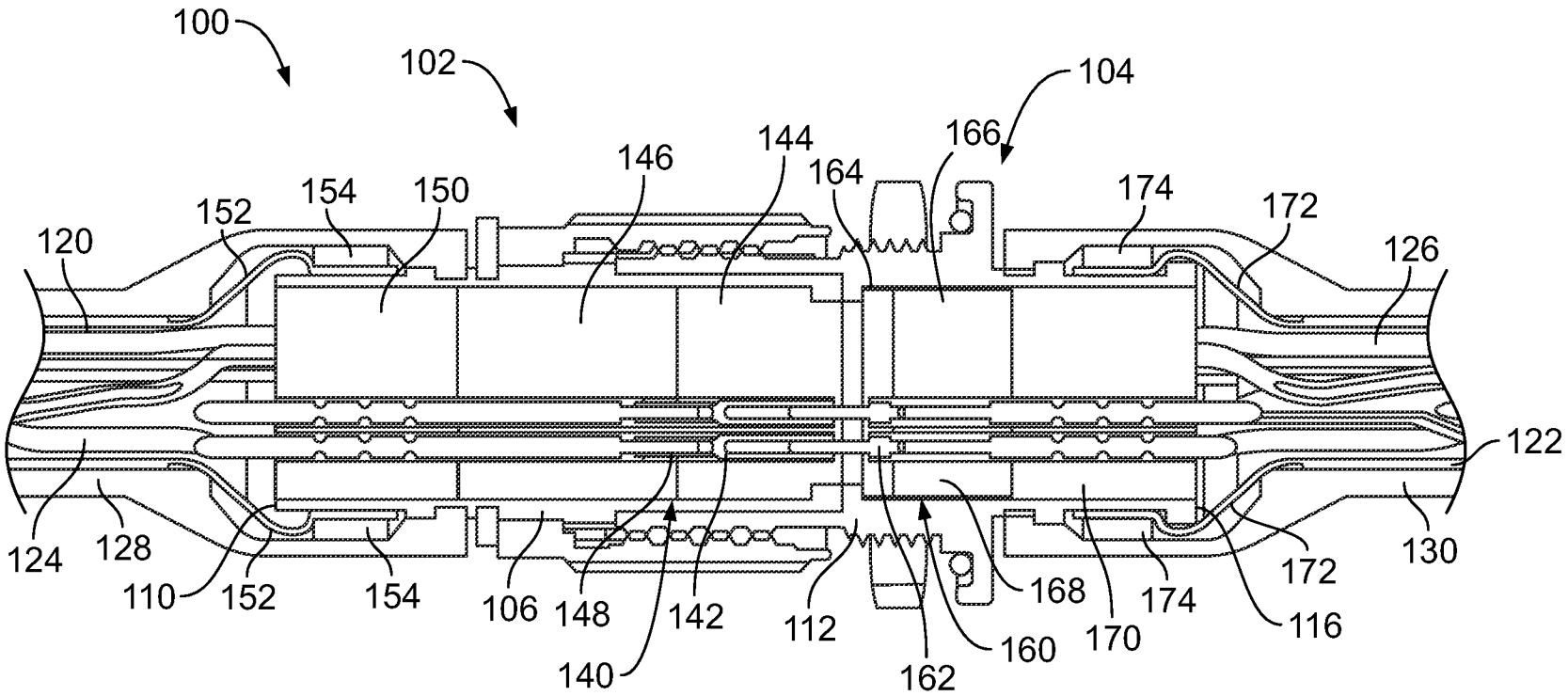
FIG. 2 is a cross-sectional view of the connector system shown in FIG. 1.

FIG. 2 is a cross-sectional view of the connector system 100 showing the female electrical connector 102 coupled to the male electrical connector 104. The female electrical connector 102 includes a dielectric housing 140 received in the shell 106. The dielectric housing 140 holds a plurality of contacts 142 therein. In the illustrated embodiment, the dielectric housing 140 is a two part housing having a front housing 144 and a rear housing 146. The contacts 142 are secured within the dielectric housing 140 using a retention clip 148 that is positioned between the front and rear housing 144, 146. The contacts 142 are terminated to ends of the wires 124, such as by a crimp connection. The wires 124 extend through a seal 150 provided rearward of the dielectric housing 140. The seal 150 is held within the shell 106.

The cable 120 includes a shield 152 circumferentially surrounding the wires 124. The shield 152 provides electrical shielding for the wires 124 along the length of the cable 120. In an exemplary embodiment, the shield 152 is a cable braid. The shield 152 is terminated to the shell 106 using a radial clamp 154. The radial clamp 154 surrounds the shield 152 and the cable end 110 of the shell 106. The radial clamp 154 imparts a normal force on the shield 152 for mechanical retention of the shield 152 to the shell 106. The radial clamp 154 ensures electrical connectivity between the shield 152 and the shell 106. The radial clamp 154 squeezes against the shield 152 to ensure that the shield 152 maintains electrical contact with the shell 106. The radial clamp 154 extends circumferentially around the shield 152 and provides a constant normal force for 360° around the shield 152.

The radial clamp 154 has a low profile such that the boot 128 is capable of being applied over the radial clamp 154. The boot 128 may be applied over the radial clamp 154, the shield 152 and the shell 106 at the cable end 110 of the shell 106 by heat shrinking the boot 128 over the shield termination. In an exemplary embodiment, the shell 106 includes a recess or groove defined between a pair of lips or flanges at the cable end 110 of the shell 106. The radial clamp 154 and shield 152 are received in the groove and positioned between the flanges. Alternatively, only a rearward flange is provided behind the position of the radial clamp 154. The rearward flange provides a surface that blocks the radial clamp 154 and/or shield 152 from being pulled off the shell 106. The flange anchors the radial clamp 154 and/or shield 152 to the shell 106 and resists rearward sliding of the radial clamp 154 and/or shield 152. The engagement between the radial clamp 154 and/or shield 152 and the rearward flange acts as a strain relief feature for the cable. Optionally, the edge surfaces of the rearward flange and the radial clamp 154 that abut against one another may be counter angled to better retain the shield 152 between the radial clamp 154 and the flange (e.g. by forcing the shield 152 to bend greater than 90° in transitioning out of the recess.

The male electrical connector 104 includes a dielectric housing 160 received in the shell 112. The dielectric housing 160 holds a plurality of contacts 162 therein. In the illustrated embodiment, the dielectric housing 160 is a two part housing having a front housing 164 and a rear housing 166. The contacts 162 are secured within the dielectric housing 160 using a retention clip 168 that is positioned between the front and rear housing 164, 166. The contacts 162 are terminated to ends of the wires 126, such as by a crimp connection. The wires 126 extend through a seal 170 provided rearward of the dielectric housing 160. The seal 170 is held within the shell 112.

The cable 122 includes a shield 172 circumferentially surrounding the wires 126. The shield 172 provides electrical shielding for the wires 126 along the length of the cable 122. In an exemplary embodiment, the shield 172 is a cable braid. The shield 172 is terminated to the shell 112 using a radial clamp 174. The radial clamp 174 surrounds the shield 172 and the cable end 116 of the shell 112. The radial clamp 174 may be substantially similar to the radial clamp 154. The boot 130 may be applied over the radial clamp 174, the shield 172 and the shell 112 at the cable end 116 of the shell 112 by heat shrinking the boot 130 over the shield termination.

In an exemplary embodiment, the shell 112 includes a recess or groove defined between a pair of lips or flanges at the cable end 116 of the shell 112. The radial clamp 174 and shield 172 are received in the groove and positioned between the flanges. Alternatively, only a rearward flange is provided behind the position of the radial clamp 174. The rearward flange provides a surface that blocks the radial clamp 174 and/or shield 172 from being pulled off the shell 112. The flange anchors the radial clamp 174 and/or shield 172 to the shell 112 and resists rearward sliding of the radial clamp 174 and/or shield 172. The engagement between the radial clamp 174 and/or shield 172 and the rearward flange acts as a strain relief feature for the cable. Optionally, the edge surfaces of the rearward flange and the radial clamp 174 that abut against one another may be counter angled to better retain the shield 172 between the radial clamp 174 and the flange (e.g. by forcing the shield 172 to bend greater than 90° in transitioning out of the recess.

Figure 3:
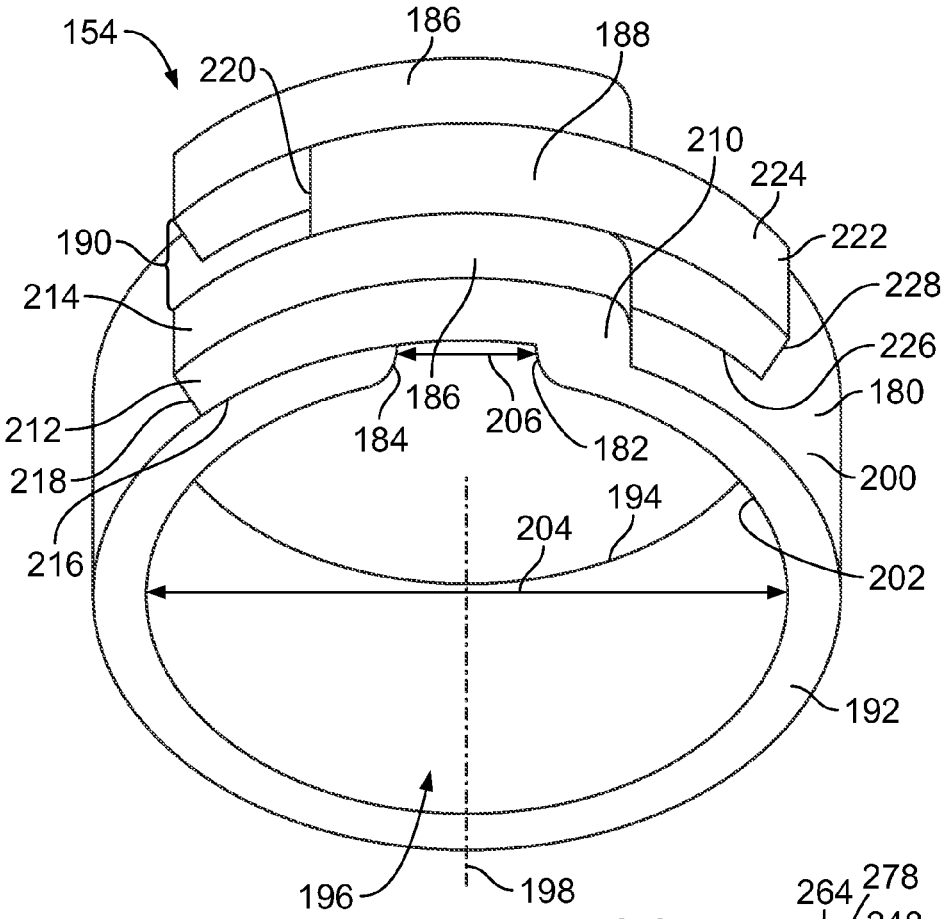
FIG. 3 is a perspective view of a radial clamp for use with an electrical connector of the connector system.

FIG. 3 is a perspective view of the radial clamp 154. The radial clamp 154 includes a clamp body 180 extending between a first end 182 and a second end 184. The clamp body 180 is of a split ring design where the first and second ends 182, 184 oppose one another and are movable with respect to one another to change a size of the clamp body 180. One or more fingers 186 extend from the first end 182 and one or more fingers 188 extend from the second end 184. In the illustrated embodiment, a pair of fingers 186 extends from the first end 182 and single finger 188 extends from the second end 184, which is received between the pair of fingers 186. The pair of fingers 186 defines a track 190 therebetween where the finger 188 is received within the track 190 and guided by the track 190. The fingers 186, 188 are configured to engage one another to guide relative movement therebetween. Other configurations of the fingers 186, 188 are possible in alternative embodiments, including a single finger 186 and a single finger 188.

The clamp body 180 has a first side 192 and a second side 194 opposite the first side 192. The clamp body 180 has an opening 196 extending along a clamp axis 198 between the first and second sides 192, 194. The clamp body 180 has an outer surface 200 and an inner surface 202 that defines the opening 196. The clamp body 180 is generally circular in shape surrounding the clamp axis 198.

The clamp body 180 is manufactured from a resilient material, such as a metal material that is configured to be elastically deformed and then, upon unloading, return to its original shape. The clamp body 180 has an inner diameter 204. During use, the clamp body 180 may be enlarged by spreading the first end 182 and second end 184 apart from one another, increasing the diameter 204. For example, the clamp body 180 may be spread apart to position the radial clamp 154 in position over the shield 152 (shown in FIG. 2) and the shell 106 (shown in FIG. 2). In an exemplary embodiment, the clamp body 180 is opened by squeezing the fingers 186, 188 to spread the first end 182 apart from the second end 184 to create or enlarge a gap 206 therebetween. Once positioned, the clamp body 180 is allowed to return to the normal position by closing the gap 206 between the first and second ends 182, 184.

As the clamp body 180 closes, the clamp body 180 presses the shield 152 against the shell 106. The shell 106 may have a diameter that is larger than the diameter 204 of the clamp body 180 when the clamp body 180 is in the normal or relaxed state. As such, the clamp body 180 may not fully close when released, but rather may remain partially open, which allows the radial clamp 154 to impart a constant normal force on the shield 152. The radial clamp 154 applies constant pressure to the shield 152 because the clamp body 180 remains in a partially elastically deformed state when the radial clamp 154 is positioned over the shield 152 and the shell 106. The radial clamp 154 provides strain relief for the cable by holding the shield 152. Optionally, the clamp body 180 may be opened to accommodate a plurality of different sized shells 106 that have a range of sizes or diameters.

Each finger 186 extends between a fixed end 210 and a free end 212. The finger 186 has an outer surface 214 and an inner surface 216 that is positioned radially inward of the outer surface 214. The fixed end 210 is attached to the first end 182. Optionally, the fixed end 210 extends from the outer surface 200 such that the finger 186 is positioned radially outward of the outer surface 200. The finger 186 generally follows a curvature of the clamp body 180 such that the inner surface 216 rests on, and is coincident with, the outer surface 200 of the clamp body 180. The finger 186 is curved to match the curvature of the clamp body 180. The finger 186 has a tool engagement surface 218 at the free end 212. The tool engagement surface 218 is configured to be engaged by and actuated by a tool to squeeze the clamp body 180 open. The tool may be a simple, readily available tool, such as pliers.

The finger 188 extends between a fixed end 220 and a free end 222. The finger 188 has an outer surface 224 and an inner surface 226 that is positioned radially inward of the outer surface 224. The fixed end 220 is attached to the second end 184. Optionally, the fixed end 220 extends from the outer surface 200 such that the finger 188 is positioned radially outward of the outer surface 200. The finger 188 generally follows a curvature of the clamp body 180 such that the inner surface 226 rests on, and is coincident with, the outer surface 200 of the clamp body 180. The finger 188 is curved to match the curvature of the clamp body 180. The finger 188 has a tool engagement surface 228 at the free end 222. The tool engagement surface 228 is configured to be engaged by and actuated by a tool to squeeze the clamp body 180 open.

During use, the tool is used to squeeze open the clamp body 180. For example, the tool is positioned to engage the tool engagement surface 218 and the tool engagement surface 228 of the fingers 186, 188, respectively. The tool is actuated to press the tool against the tool engagement surfaces 218, 228. As the tool is actuated, the fingers 186, 188 slide relative to one another to open the gap 206. The finger 188 is guided by the fingers 186 within the track 190 to control the path of movement of the fingers 186, 188 and thus the first and second ends 182, 184.

The outer surfaces 214, 224 of the fingers 186, 188 have a matched contour to that of the outer surface 200 of the clamp body 180. The outer surfaces 214, 224 are positioned radially outward of the outer surface 200 by a small amount such that the radial clamp 154 has a low profile. The fingers 186 are arranged such that the free ends 212 are positioned radially outward of, and slide along, the second end 184 of the clamp body 180. Similarly, the free end 222 of the finger 188 is positioned radially outward of, and slides along, the first end 182 of the clamp body 180. The fingers 186, 188 may be actuated by the tool until the tool engages the fixed ends 210, 220 of the fingers 186, 188. The fixed ends 210, 220 define a stop for the tool. As such, the range of motion of the fingers 186, 188 is limited so as not to damage the radial clamp 154.

Figure 4:
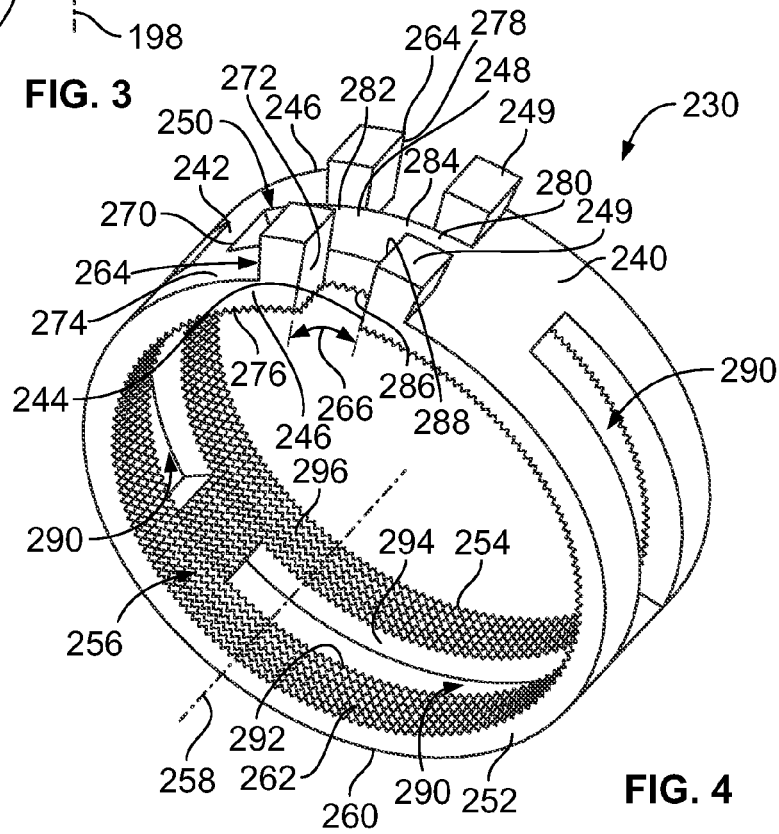
FIG. 4 is a perspective view of an alternative radial clamp formed in accordance with an alternative embodiment.

FIG. 4 is a perspective view of an alternative radial clamp 230 formed in accordance with an alternative embodiment. The radial clamp 230 is similar to the radial clamp 154 (shown in FIG. 3) and may be used in place of the radial clamp 154. The radial clamp 230 differs from the radial clamp 154 in that the radial clamp 230 includes a different configuration of fingers and tool engagement surfaces. The radial clamp 230 also includes features to increase a grip factor with the shield 152 (shown in FIG. 2).

The radial clamp 230 includes a clamp body 240 extending between a first end 242 and a second end 244. The clamp body 240 is of a split ring design where the first and second ends 242, 244 oppose one another and are movable with respect to one another to change a size of the clamp body 240. One or more fingers 246 extend from the first end 242 and one or more fingers 248, 249 extend from the second end 244. In the illustrated embodiment, a pair of fingers 246 extends from the first end 242 and three fingers 248, 249 extend from the second end 244, with a single circumferential finger 248 extending along the circumference of the clamp body 240 and with two radial fingers 249 extending radially outward from the clamp body 240. The pair of fingers 246 defines a track 250 therebetween where the circumferential finger 248 is received within the track 250 and guided by the track 250. The fingers 246, 248 are configured to engage one another to guide relative movement therebetween.

The clamp body 240 has a first side 252 and a second side 254 opposite the first side 252. The clamp body 240 has an opening 256 extending along a clamp axis 258 between the first and second sides 252, 254. The clamp body 240 has an outer surface 260 and an inner surface 262 that defines the opening 256. The clamp body 240 is generally circular in shape surrounding the clamp axis 258.

The fingers 246 have radial segments 264 extending radially outward from distal ends of the fingers 246. The radial segments 264 oppose the radial fingers 249. The radial segments 264 and the radial fingers 249 are positioned radially outward of the outer surface 260 by a small amount such that the radial clamp 230 has a low profile. In an exemplary embodiment, the clamp body 240 is opened by prying the fingers 246, 249 apart to spread the first end 242 apart from the second end 244 to create or enlarge a gap 266 therebetween.

Each finger 246 extends between a fixed end 270 and a free end 272. The finger 246 has an outer surface 274 and an inner surface 276 that are circumferentially aligned with the outer and inner surfaces 260, 262 of the clamp body 240. The radial segments 264 extend radially outward from the outer surfaces 260 at the free end 272. The fixed end 270 extends from the first end 242. The finger 246 generally follows a curvature of the clamp body 240. The finger 246 is curved to match the curvature of the clamp body 240. The radial segments 264 of the fingers 246 have tool engagement surfaces 278. The tool engagement surfaces 278 are configured to be engaged by and actuated by a tool to pry the clamp body 240 open.

The finger 248 extends between a fixed end 280 and a free end 282. The finger 248 has an outer surface 284 and an inner surface 286 that are circumferentially aligned with the outer and inner surfaces 260, 262 of the clamp body 240. The fixed end 280 extends from the second end 244. The finger 248 generally follows a curvature of the clamp body 240. The finger 248 is curved to match the curvature of the clamp body 240.

The radial fingers 249 have tool engagement surfaces 288. The tool engagement surfaces 288 are configured to be engaged by and actuated by a tool to pry the clamp body 240 open. As the tool is actuated, the fingers 246, 248 slide relative to one another to open the gap 266. The finger 248 is guided by the fingers 246 within the track 250 to control the path of movement of the fingers 246, 248 and thus the first and second ends 242, 244.

The clamp body 240 includes one or more slots 290 extending therethrough. The slots 290 extend at least partially circumferentially around the opening 256. The slots 290 are spaced apart from the first and second sides 252, 254. The slots 290 are defined by ledges 292, 294 on opposite sides of the slots 290. The ledges 292, 294 extend generally radially outward from the opening 256. The ledges 292, 294 may be perpendicular to the clamp axis 258. The ledges 292, 294 may be generally parallel to the first and second sides 252, 254. When the radial clamp 230 is positioned on and engaging the shield 152, at least a portion of the shield 152 may be at least partially extruded into the slots 290. The ledges 292, 294 define shoulders or surfaces that engage the shield 152 to provide additional grip for holding the relative position of the radial clamp 230 and the shield 152.

The clamp body 240 has a knurled surface 296 along the inner surface 262 of the clamp body 240. The knurled surface 296 engages the shield 152. The knurled surface 296 provides additional grip for holding the relative position of the radial clamp 230 and the shield 152.

Figure 5:
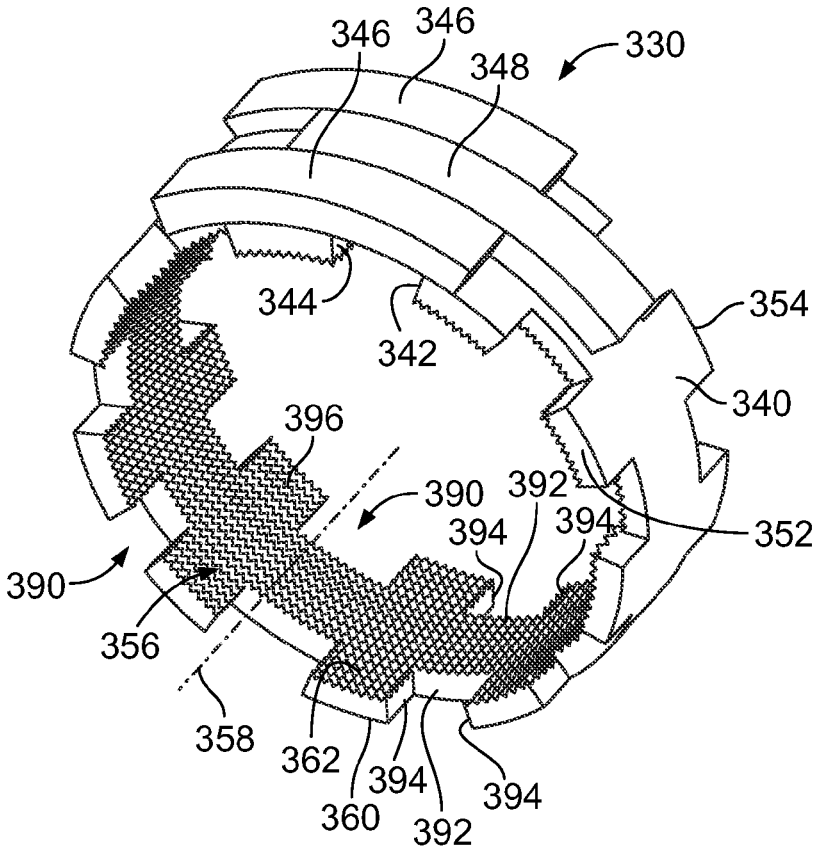
FIG. 5 is a perspective view of an alternative radial clamp formed in accordance with an alternative embodiment.

FIG. 5 is a perspective view of an alternative radial clamp 330 formed in accordance with an alternative embodiment. The radial clamp 330 is similar to the radial clamp 154 (shown in FIG. 3) and may be used in place of the radial clamp 154. The radial clamp 330 differs from the radial clamp 154 in that the radial clamp 330 includes features to increase a grip factor with the shield 152 (shown in FIG. 3).

The radial clamp 330 includes a clamp body 340 extending between a first end 342 and a second end 344. The clamp body 340 is of a split ring design where the first and second ends 342, 344 oppose one another and are movable with respect to one another to change a size of the clamp body 340. One or more fingers 346 extend from the first end 342 and one or more fingers 348 extend from the second end 344.

The clamp body 340 has a first side 352 and a second side 354 opposite the first side 352. The clamp body 340 has an opening 356 extending along a clamp axis 358 between the first and second sides 352, 354. The clamp body 340 has an outer surface 360 and an inner surface 362 that defines the opening 356. The clamp body 340 is generally circular in shape surrounding the clamp axis 358.

The clamp body 340 includes a plurality of slots 390 extending therethrough. The slots 390 extend at least partially circumferentially around the opening 356. The slots 390 are open along the first and second sides 352, 354. The slots 390 are defined by circumferential ledges 392 and axial ledges 394. The ledges 392, 394 extend generally radially outward from the opening 356. When the radial clamp 330 is positioned on and engaging the shield 152, at least a portion of the shield 152 may be at least partially extruded into the slots 390. The ledges 392, 394 define shoulders or surfaces that engage the shield 152 to provide additional grip for holding the relative position of the radial clamp 330 and the shield 152.

The clamp body 340 has a knurled surface 396 along the inner surface 362 of the clamp body 340. The knurled surface 396 engages the shield 152. The knurled surface 396 provides additional grip for holding the relative position of the radial clamp 330 and the shield 152.

Figure 6:
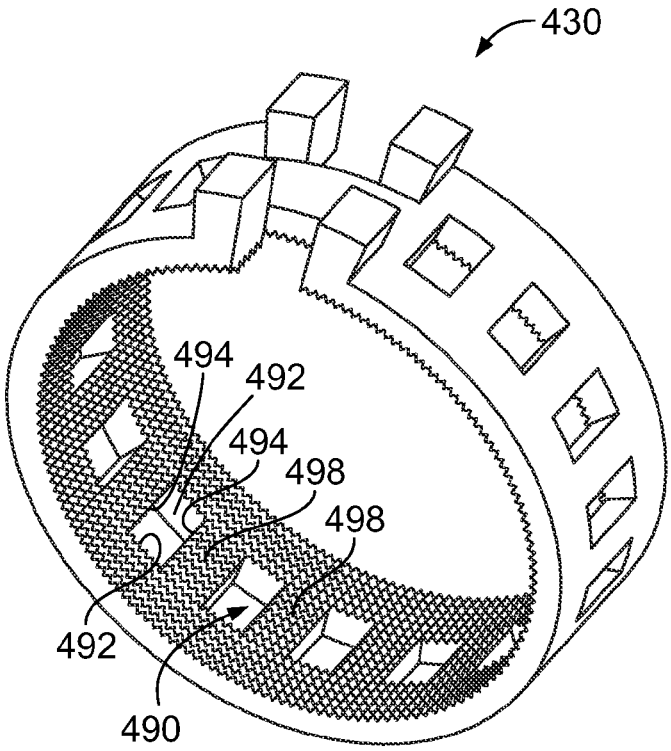
FIG. 6 is a perspective view of an alternative radial clamp formed in accordance with an alternative embodiment.

FIG. 6 is a perspective view of an alternative radial clamp 430 formed in accordance with an alternative embodiment. The radial clamp 430 is similar to the radial clamp 230 (shown in FIG. 4) and may be used in place of the radial clamp 230. The radial clamp 430 differs from the radial clamp 230 in that the radial clamp 430 includes a different arrangement of slots 490 than the slots 290 (shown in FIG. 4).

The slots 490 are defined by circumferential ledges 392 and axial ledges 394. The radial clamp 430 includes many slots 490, increasing the surface area of ledges 492, 494 as compared to the slots 290. Additionally, by having many axial segments 498, the mechanical strength and/or clamping force of the radial clamp 430 may be higher than the design of the radial clamp 230 for a given material/thickness of material.

Figure 7:
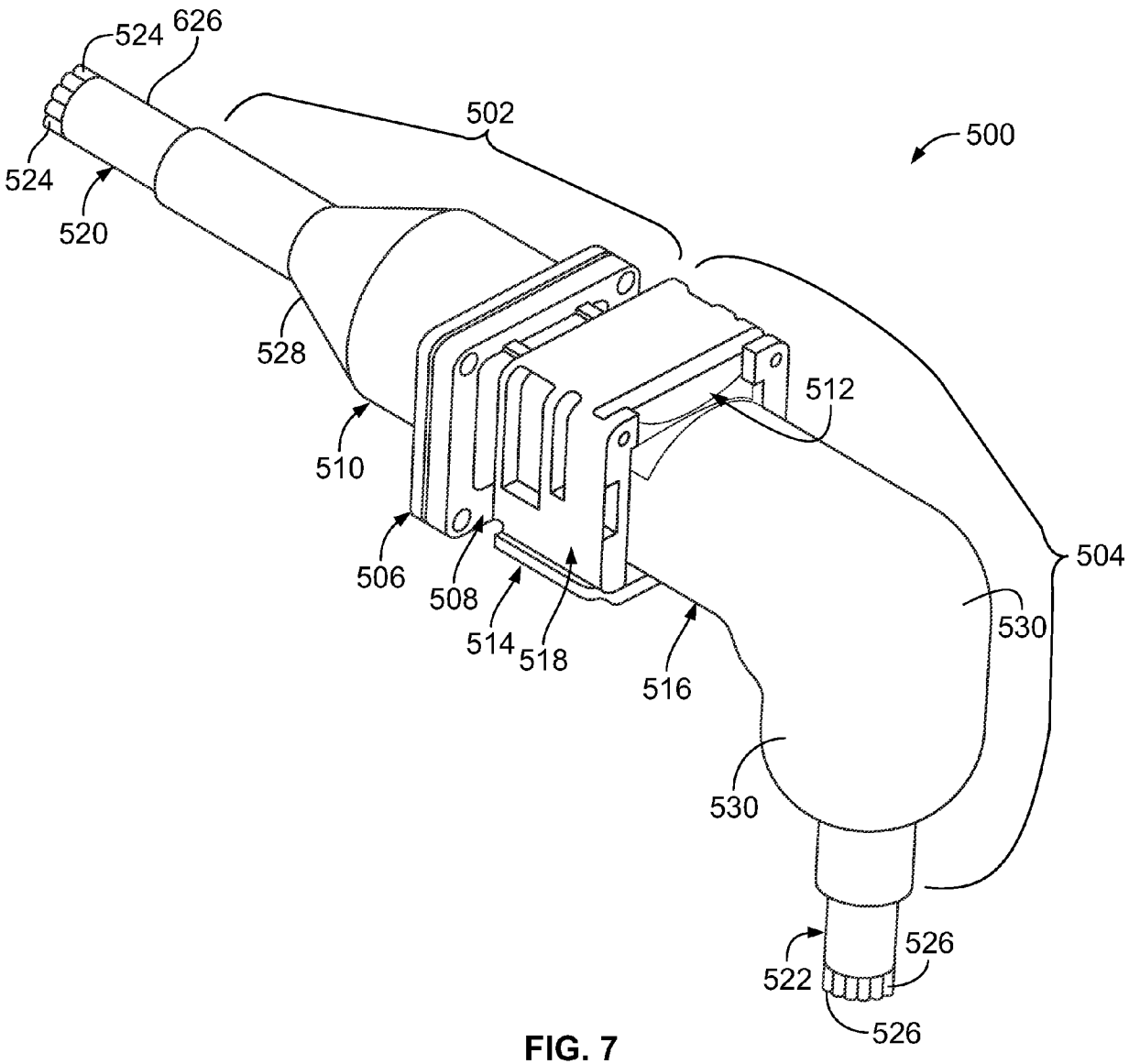
FIG. 7 is a perspective view of another connector system formed in accordance with one embodiment.

FIG. 7 is a perspective view of another connector system 500 according to one embodiment. The connector system 500 includes a female electrical connector 502 and a male electrical connector 504. In the illustrated embodiment, the female and male electrical connectors 502, 504 are shielded RF connectors, however other types of connectors may be used in alternative embodiments. The electrical connectors 502, 504 may be high data rate connectors. The female and male electrical connectors 502, 504 may be adapted for use in military applications, aerospace applications, automotive applications, industrial applications, commercial applications, and the like. Each of the female electrical connector 502 and the male electrical connector 504 may be referred to herein as a "mating connector".

The female electrical connector 502 includes a housing 506 extending between a mating end 508 and a cable end 510. The male electrical connector 504 includes a housing 512 extending between a mating end 514 and a cable end 516. The mating ends 508, 514 are connected together and secured together using a lock 518. In the illustrated embodiment, the lock 518 is a latch, however other types of locks may be used in alternative embodiments, such as threaded collars, fasteners, and the like.

The female electrical connector 502 is terminated to an end of a cable 520 and the male electrical connector 504 is terminated an end of a cable 522. The cables 520, 522 each include a plurality of wires 524, 526. Any number of wires 524, 526 may be provided. Optionally, the wires 524, 526 may be arranged as twisted wire pairs, where the wires carry differential signals. The wires 524, 526 may be part of a quad cable having multiple wires. A boot 528 is provided over the cable end 510 of the female electrical connector 502 to secure the cable 520 to the housing 506. The boot 528 provides strain relief between the cable 520 and the housing 506. A boot 530 is provided over the cable end 516 of the male electrical connector 504 to secure the cable 522 to the housing 512. The boot 530 provides strain relief between the cable 522 and the housing 512.

Figure 8:
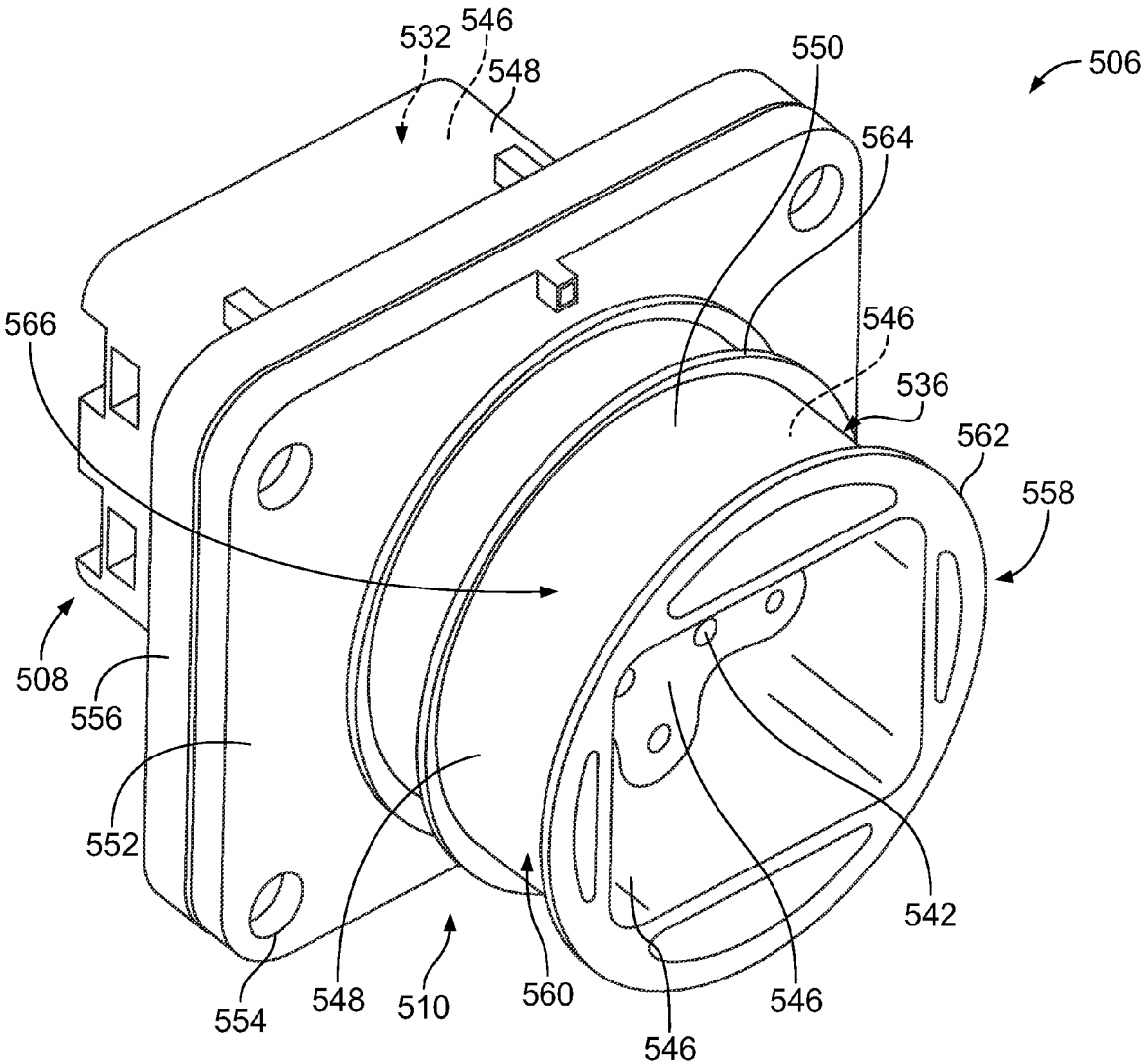
FIG. 8 is a perspective view of a housing of a female electrical connector of the connector system shown in FIG. 7.
Figure 9:
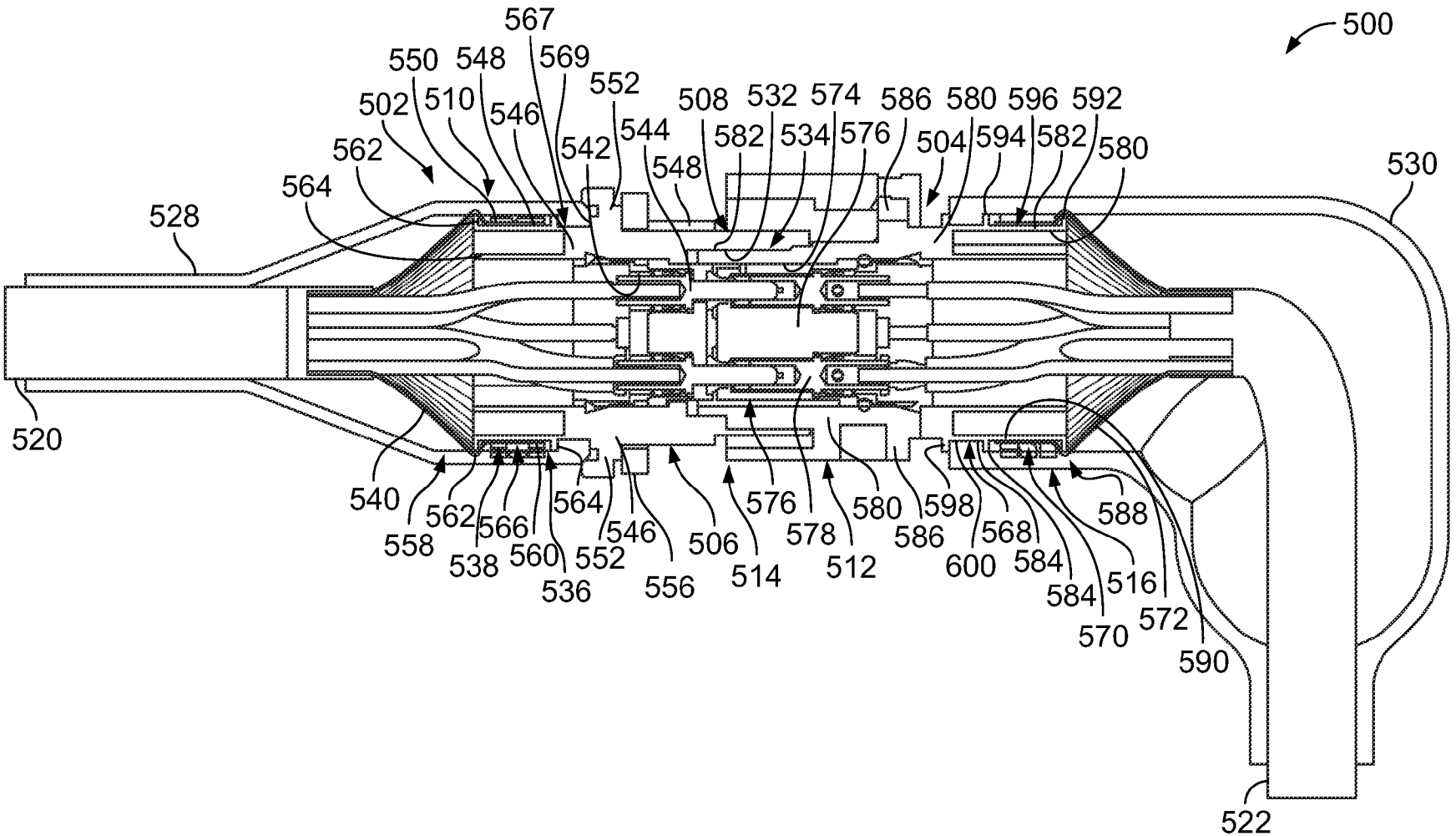
FIG. 9 is a cross-sectional view of the connector system shown in FIG. 7.

FIG. 8 is a perspective view of the housing 506 of the female electrical connector 502. FIG. 9 is a cross-sectional view of the connector system 500. Referring now to FIGS. 8 and 9, the housing 506 extends from the mating end 508 to the cable end 510. The housing 506 is configured to mate with the male electrical connector 504 (not shown in FIG. 8) at the mating end 508. In the illustrated embodiment, the mating end 508 of the housing 506 includes a receptacle 532 that receives a plug 534 (not shown in FIG. 8) of the male electrical connector 504 therein. The cable end 510 of the housing 506 includes a shield fitting 536 that is configured to hold an end 538 (not shown in FIG. 8) of a shield 540 (not shown in FIG. 8) of the cable 520 (not shown in FIG. 8), as will be described in more detail below. The housing 506 may include one or more contact cavities 542 for directly holding one or more electrical contacts 544 (not shown in FIG. 8) of the female electrical connector 502. Alternatively, the housing 506 includes one or more interior cavities for holding a dielectric insert (not shown) that holds the one or more electrical contacts 544 of the female electrical connector 502.

The housing 506 includes a dielectric member 546 and an electrically conductive material 548 extending on the dielectric member 546. The electrically conductive material 548 enables the housing 506 to electrically connect to the shield 540 of the cable 520 and to form a portion of an electrical circuit (e.g., an electrical ground, a shield circuit, and/or the like) that includes the shield 540. The electrically conductive material 548 may extend on any amount, any portion(s), and any location(s) of the dielectric member 546 that enables the housing 506 to electrically connect to the shield 540 and form a portion of the electrical circuit that includes the shield 540. In the illustrated embodiment, the electrically conductive material 548 extends on the dielectric member 546 at the shield fitting 536 to enable the housing 506 to electrically connect to the shield 540 via engagement between the shield 540 and the shield fitting 536. In other words, the electrically conductive material 548 forms at least a portion of an exterior surface 550 of the shield fitting 536. The electrically conductive material 548 may extend on the dielectric member 546 within the receptacle 532 of the housing 506, and/or on another location of the housing 506, to enable the housing 506 to electrically connect the shield 540 to the housing 512 (not shown in FIG. 8) of the male electrical connector 504.

In some embodiments, the electrically conductive material 548 is a coating that coats one or more surfaces of the dielectric member 542. In other embodiments, the electrically conductive material 548 is a shell that is mounted on and holds the dielectric member 542. In still other embodiments, the housing 506 includes both an electrically conductive material 548 that is a coating and an electrically conductive material 548 that is a shell that is mounted on and holds the dielectric member 546. When the electrically conductive material 548 is a coating, the coating may be applied on dielectric member 546 using any method, process, structure, means, and/or the like. Examples of suitable processes for applying the coating of the electrically conductive material 548 on the dielectric member 546 include, but are not limited to, chemical solution deposition (CSD), chemical vapor deposition (CVD), physical vapor deposition (PVD), atomic layer deposition (ALD), electrodeposition, electrocoating, electroplating, screen printing, dip coating, aerosol coating, spin coating, sputtering, and/or the like. As used herein, the electrically conductive material 548 is considered to be a coating when the electrically conductive material 548 is applied on the dielectric member 546 using a plating process.

The housing 506 optionally includes a platform 552 for securing the housing 506 to a panel, wall, and/or other structure. The platform 552 optionally includes one or more mounting openings 554 (not visible in FIG. 9) for securing the housing 506 to the panel, wall, and/or other structure. A gasket 556 is optionally provided to seal the housing 506 to the panel, wall, and/or other structure.

The shield fitting 536 extends a length outwardly from the platform 552 to an end 558. The shield fitting 536 includes the exterior surface 550, which as can be seen in FIG. 8 includes an outer profile having a circular shape in the illustrated embodiment. The shield fitting 536 includes a base 560 and a pair of lips or flanges 562, 564. The flanges 562, 564 extend radially outward from the base 560. The flange 562 optionally extends at the end 558. The flanges 562, 564 are spaced apart along the length of the shield fitting 536 such that a recess, or groove, 566 is defined between the flanges 562, 564. An optional recess, or groove, 567 is defined between the flange 564 and a wall 569 of the housing 506. The flange 562 may be referred to herein as a "first flange" and/or a "second flange". The flange 564 may be referred to herein as a "first flange" and/or a "second flange".

Figure 10:
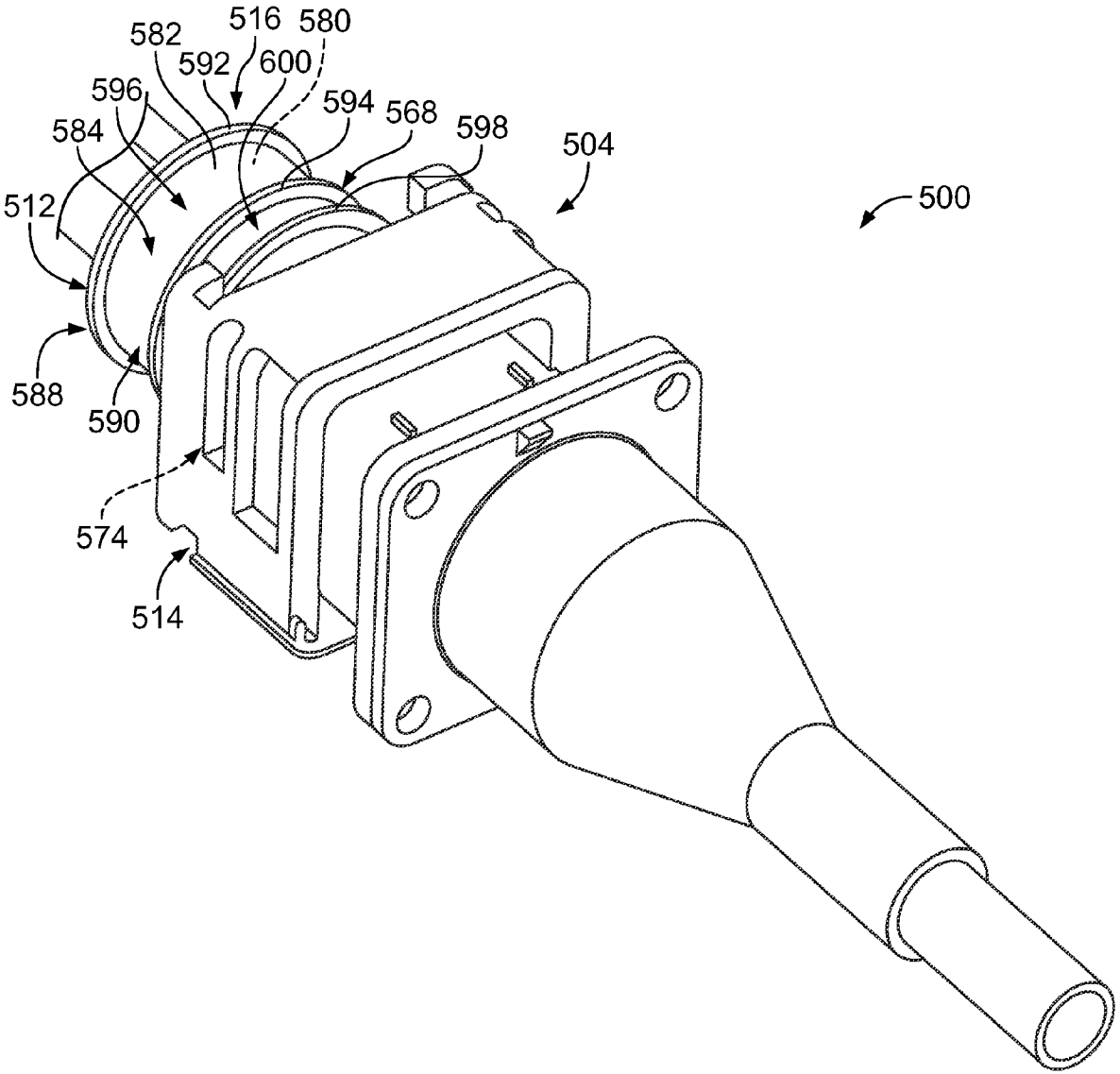
FIG. 10 is a perspective view of a portion of the connector system shown in FIGS. 7 and 9 illustrating a housing of a male electrical connector of the connector system.

FIG. 10 is a perspective view of a portion of the connector system 500 illustrating the housing 512 of the male electrical connector 504. The boot 530 has been removed from FIG. 10 to illustrate the housing 512. Referring now to FIGS. 9 and 10, the housing 512 extends from the mating end 514 to the cable end 516. The housing 512 is configured to mate with the female electrical connector 502 (not shown in FIG. 10) at the mating end 514. In the illustrated embodiment, the mating end 514 of the housing 512 includes the plug 534 (not visible in FIG. 10) that is received within the receptacle 532 (not shown in FIG. 10) of the female electrical connector 502. The cable end 516 of the housing 512 includes a shield fitting 568 that is configured to hold an end 570 (not shown in FIG. 10) of a shield 572 (not shown in FIG. 10) of the cable 522 (not shown in FIG. 10). The housing 512 may include one or more interior cavities 574 for holding a dielectric insert 576 (not visible in FIG. 10) that holds one or more electrical contacts 578 (not visible in FIG. 10) of the male electrical connector 504. Alternatively, the housing 512 includes one or more contact cavities (not shown) for directly holding the one or more electrical contacts 578.

The housing 512 includes a dielectric member 580 and an electrically conductive material 582 extending on the dielectric member 580. The electrically conductive material 582 enables the housing 512 to electrically connect to the shield 572 of the cable 522 and to form a portion of an electrical circuit (e.g., an electrical ground, a shield circuit, and/or the like) that includes the shield 572. The electrically conductive material 582 may extend on any amount, any portion(s), and any location(s) of the dielectric member 580 that enables the housing 512 to electrically connect to the shield 572 and form a portion of the electrical circuit that includes the shield 572. In the illustrated embodiment, the electrically conductive material 582 extends on the dielectric member 580 at the shield fitting 568 to enable the housing 512 to electrically connect to the shield 572 via engagement between the shield 572 and the shield fitting 568. In other words, the electrically conductive material 582 forms at least a portion of an exterior surface 584 of the shield fitting 568. The electrically conductive material 582 may extend on the dielectric member 580 at the plug 534 of the housing 512, and/or on another location of the housing 512, to enable the housing 512 to electrically connect the shield 572 to the housing 506 (not shown in FIG. 10) of the female electrical connector 502.

In some embodiments, the electrically conductive material 582 is a coating that coats one or more surfaces of the dielectric member 580. In other embodiments, the electrically conductive material 582 is a shell that is mounted on and holds the dielectric member 580. In still other embodiments, the housing 512 includes both an electrically conductive material 582 that is a coating and an electrically conductive material 582 that is a shell that is mounted on and holds the dielectric member 580. When the electrically conductive material 582 is a coating, the coating may be applied on dielectric member 580 using any method, process, structure, means, and/or the like. Examples of suitable processes for applying the coating of the electrically conductive material 582 on the dielectric member 580 include, but are not limited to, chemical solution deposition (CSD), chemical vapor deposition (CVD), physical vapor deposition (PVD), atomic layer deposition (ALD), electrodeposition, electrocoating, electroplating, screen printing, dip coating, aerosol coating, spin coating, sputtering, and/or the like. As used herein, the electrically conductive material 582 is considered to be a coating when the electrically conductive material 582 is applied on the dielectric member 580 using a plating process.

The housing 512 optionally includes a platform 586 (not visible in FIG. 10). The shield fitting 568 extends a length outwardly from the platform 586 to an end 588. The shield fitting 568 includes the exterior surface 584, which as can be seen in FIG. 10 includes an outer profile having a circular shape in the illustrated embodiment. The shield fitting 568 includes a base 590 and a pair of lips or flanges 592, 594. The flanges 592, 594 extend radially outward from the base 590. The flanges 592, 594 are spaced apart along the length of the shield fitting 568 such that a recess, or groove, 596 is defined between the flanges 592, 594. Optionally, the shield fitting 568 includes another flange 598 that extends radially outward from the base 590. A recess, or groove, 600 is defined between the flange 594 and the flange 598. The flange 592 may be referred to herein as a "first flange" and/or a "second flange". The flange 594 may be referred to herein as a "first flange" and/or a "second flange".

Figure 11:
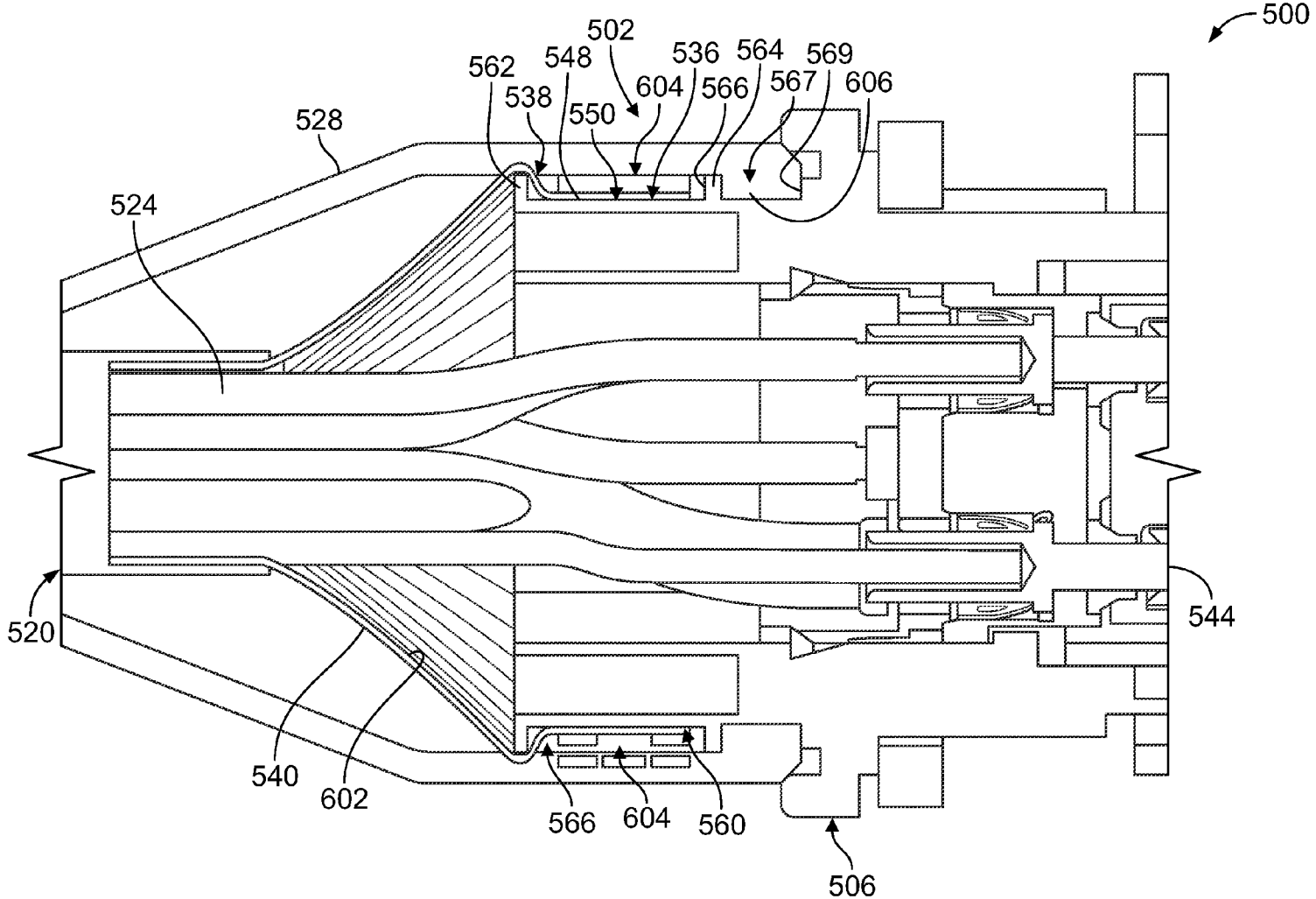
FIG. 11 is an enlarged cross-sectional view of a portion of the connector system shown in FIGS. 7 and 9.

FIG. 11 is an enlarged cross-sectional view of a portion of the connector system 500 illustrating termination of the shield 540 to the housing 506 of the female electrical connector 502. The electrical contacts 544 of the female electrical connector 502 are terminated to ends of the wires 524, such as by a crimp connection. The cable 520 includes the shield 540, which circumferentially surrounds the wires 524. The shield 540 provides electrical shielding for the wires 524 along the length of the cable 520. In an exemplary embodiment, the shield 540 is a cable braid.

As can be seen in FIG. 11, the shield fitting 536 holds the end 538 of the shield 540 of the cable 520. When held by the shield fitting 536 as shown herein, the electrically conductive material 548 of the housing 506 is engaged with, and thereby electrically connected to, the shield 540. In the illustrated embodiment, the end 538 of the shield 540 is received over the exterior surface 550 of the shield fitting 536. The end 538 of the shield 540 extends over the flange 562 and into the groove 566 defined between the flanges 562, 564. An interior surface 602 of the shield 540 is engaged with the exterior surface 550 of the shield fitting 536 to establish the electrical connection between the shield 540 and the electrically conductive material 548 of the housing 506. More specifically, the interior surface 602 of the shield 540 engages the exterior surface 550 of the shield fitting 536 at the flange 562 and at the base 560 within the groove 566.

Optionally, the end 538 of the shield 540 is held on the shield fitting 536 at least partially using a radial clamp 604. Stiction, friction, the boot 528, and/or another type of device besides the clamp 604 may additionally or alternatively hold the end 538 of the shield 540 on the shield fitting 536. The radial clamp 604 surrounds the end 538 of the shield 540 and the shield fitting 536 within the groove 566. The radial clamp 604 imparts a normal force on the end 538 of the shield 540 for mechanical retention of the shield 540 to the shield fitting 536. The radial clamp 604 facilitates ensuring electrical connectivity between the shield 540 and the housing 506. For example, the radial clamp 604 mechanically presses the end 538 of the shield 540 to the shield fitting 536 to ensure that the shield 540 maintains electrical contact with the shield fitting 536. The radial clamp 604 may be any of the types of radial clamps 154, 230, 330, and/or 430 described and/or illustrated herein. But, the radial clamp 604 is not limited to the types of radial clamps 154, 230, 330, and/or 430 described and/or illustrated herein; rather, the radial clamp 604 may be any other type of clamp.

The flange 562 provides a surface that blocks the radial clamp 604 and/or the end 538 of the shield 540 from being pulled off the shield fitting 536. The flange 562 anchors the radial clamp 604 and/or the end 538 of the shield 540 to the shield fitting 536 and resists rearward sliding of the radial clamp 604 and/or the end 538 of the shield 540. The engagement between the flange 562 and the radial clamp 604 and/or the end 538 of the shield 540 may act as a strain relief feature for the cable 520. Optionally, the edge surfaces of the flange 562 and the radial clamp 604 that abut against one another may be counter angled to better retain the end 538 of the shield 540 between the radial clamp 604 and the flange 562 (e.g. by forcing the shield 540 to bend greater than 90° in transitioning out of the groove 566).

The boot 528 is mounted to the shield fitting 536. The boot 528 extends over the end 538 of the shield 540, the radial clamp 604, and the shield fitting 536. The boot 528 is mounted to the shield fitting 536 such that the boot 528 extends over the end 538 of the shield 540 and over the flange 564. Optionally, the boot 528 includes a flange 606 that extends over and engages the flange 564. The flange 606 extends within the groove 567 that is defined between the flange 564 and the wall 569. The flange 564 provides a surface that blocks the boot 528 from being pulled off the shield fitting 536. The flange 564 anchors the boot 528 to the shield fitting 536 and resists rearward sliding of the boot 528. The engagement between the flange 564 and the boot 528 may act as a strain relief feature for the cable 520. Optionally, the boot 528 may be mounted to the shield fitting 536 by heat shrinking the boot 528 over the shield termination. An adhesive is optionally provided for securing the boot 528 to the shield fitting 536, the radial clamp 604, and/or the end 538 of the shield 540.

Figure 12:
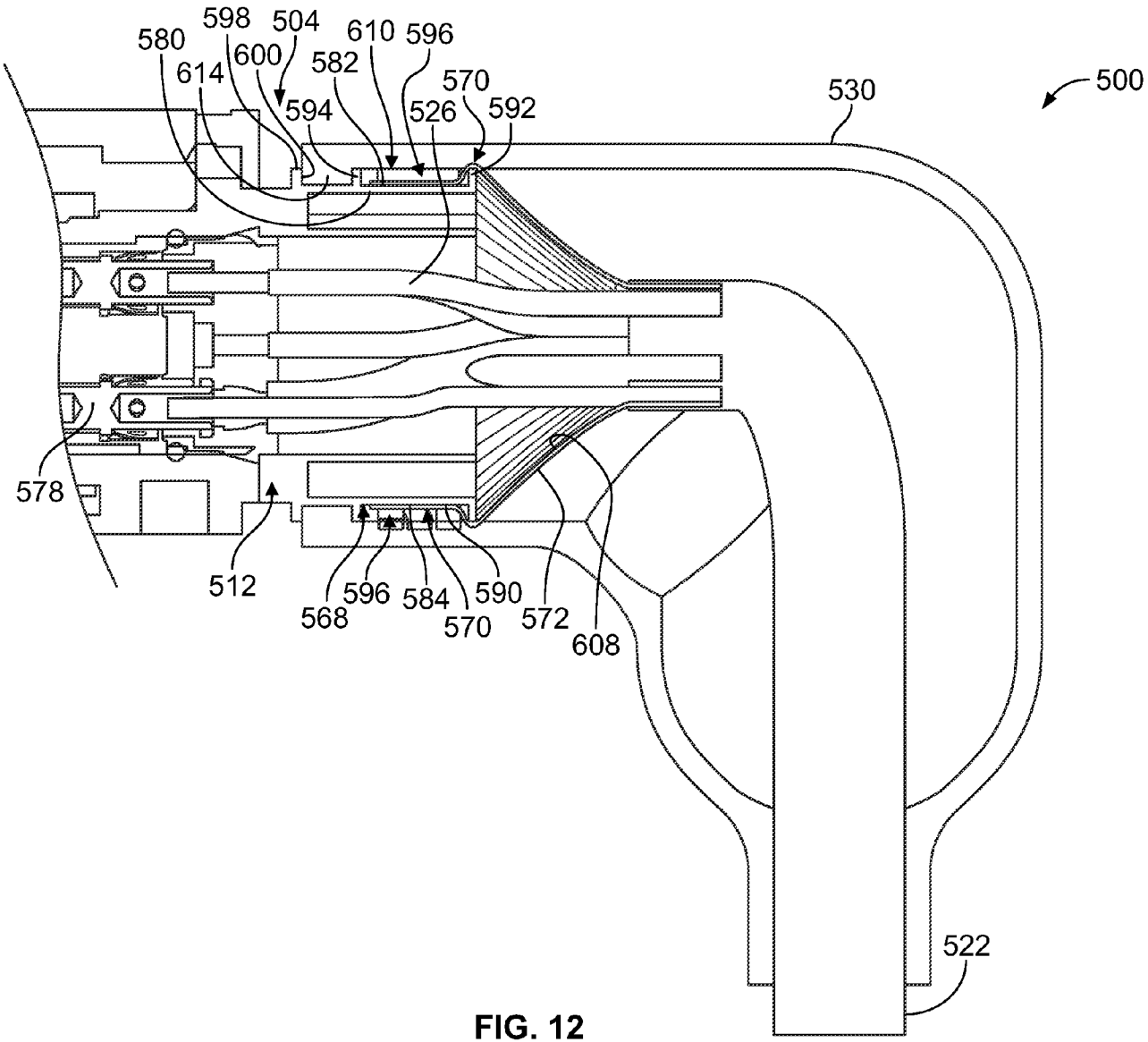
FIG. 12 is another enlarged cross-sectional view of a portion of the connector system shown in FIGS. 7 and 9.

FIG. 12 is an enlarged cross-sectional view of a portion of the connector system 500 illustrating termination of the shield 572 to the housing 512 of the male electrical connector 504. The electrical contacts 578 of the male electrical connector 504 are terminated to ends of the wires 526, such as by a crimp connection. The cable 522 includes the shield 572, which circumferentially surrounds the wires 526 to provide electrical shielding for the wires 526 along the length of the cable 522. In an exemplary embodiment, the shield 572 is a cable braid.

The shield fitting 568 holds the end 570 of the shield 572 of the cable 522. When held by the shield fitting 568, the electrically conductive material 582 of the housing 512 is engaged with, and thereby electrically connected to, the shield 572. In the illustrated embodiment, the end 570 of the shield 572 is received over the exterior surface 584 of the shield fitting 568. The end 570 of the shield 572 extends over the flange 592 and into the groove 596 defined between the flanges 592, 594. An interior surface 608 of the shield 572 is engaged with the exterior surface 584 of the shield fitting 568 to establish the electrical connection between the shield 572 and the electrically conductive material 582 of the housing 512. More specifically, the interior surface 608 of the shield 572 engages the exterior surface 584 of the shield fitting 568 at the flange 592 and at the base 590 within the groove 596.

The end 570 of the shield 572 is optionally held on the shield fitting 568 at least partially using a radial clamp 610. Stiction, friction, the boot 530, and/or another type of device besides the clamp 610 may additionally or alternatively hold the end 570 of the shield 572 on the shield fitting 568. The radial clamp 610 surrounds the end 570 of the shield 572 and the shield fitting 568 within the groove 596. The radial clamp 610 imparts a normal force on the end 570 of the shield 572 for mechanical retention of the shield 572 to the shield fitting 568. The radial clamp 610 facilitates ensuring electrical connectivity between the shield 572 and the housing 512. For example, the radial clamp 610 mechanically presses the end 570 of the shield 572 to the shield fitting 568 to ensure that the shield 572 maintains electrical contact with the shield fitting 568. The radial clamp 610 may be any of the types of radial clamps 154, 230, 330, and/or 430 described and/or illustrated herein. But, the radial clamp 610 is not limited to the types of radial clamps 154, 230, 330, and/or 430 described and/or illustrated herein; rather, the radial clamp 610 may be any other type of clamp.

The flange 592 provides a surface that blocks the radial clamp 610 and/or the end 570 of the shield 572 from being pulled off the shield fitting 568. The flange 592 anchors the radial clamp 610 and/or the end 570 of the shield 572 to the shield fitting 568 and resists rearward sliding of the radial clamp 610 and/or the end 570 of the shield 572. The engagement between the flange 592 and the radial clamp 610 and/or the end 570 of the shield 572 may act as a strain relief feature for the cable 522. Optionally, the edge surfaces of the flange 592 and the radial clamp 610 that abut against one another may be counter angled to better retain the end 570 of the shield 572 between the radial clamp 610 and the flange 592 (e.g. by forcing the shield 572 to bend greater than 90° in transitioning out of the groove 596).

The boot 530 is mounted to the shield fitting 568. The boot 530 extends over the end 570 of the shield 572, the radial clamp 610, and the shield fitting 568. The boot 530 is mounted to the shield fitting 568 such that the boot 530 extends over the end 570 of the shield 572 and over the flange 594. Optionally, the boot 530 includes a flange 614 that extends over and engages the flange 594. The flange 614 extends within the groove 600 that is defined between the flange 594 and the flange 598. The flange 594 provides a surface that blocks the boot 530 from being pulled off the shield fitting 568. The flange 594 anchors the boot 530 to the shield fitting 568 and resists rearward sliding of the boot 530. The engagement between the flange 594 and the boot 530 may act as a strain relief feature for the cable 522. Optionally, the boot 530 may be mounted to the shield fitting 568 by heat shrinking the boot 530 over the shield termination. An adhesive is optionally provided for securing the boot 530 to the shield fitting 568, the radial clamp 610, and/or the end 570 of the shield 572.

Figure 13:
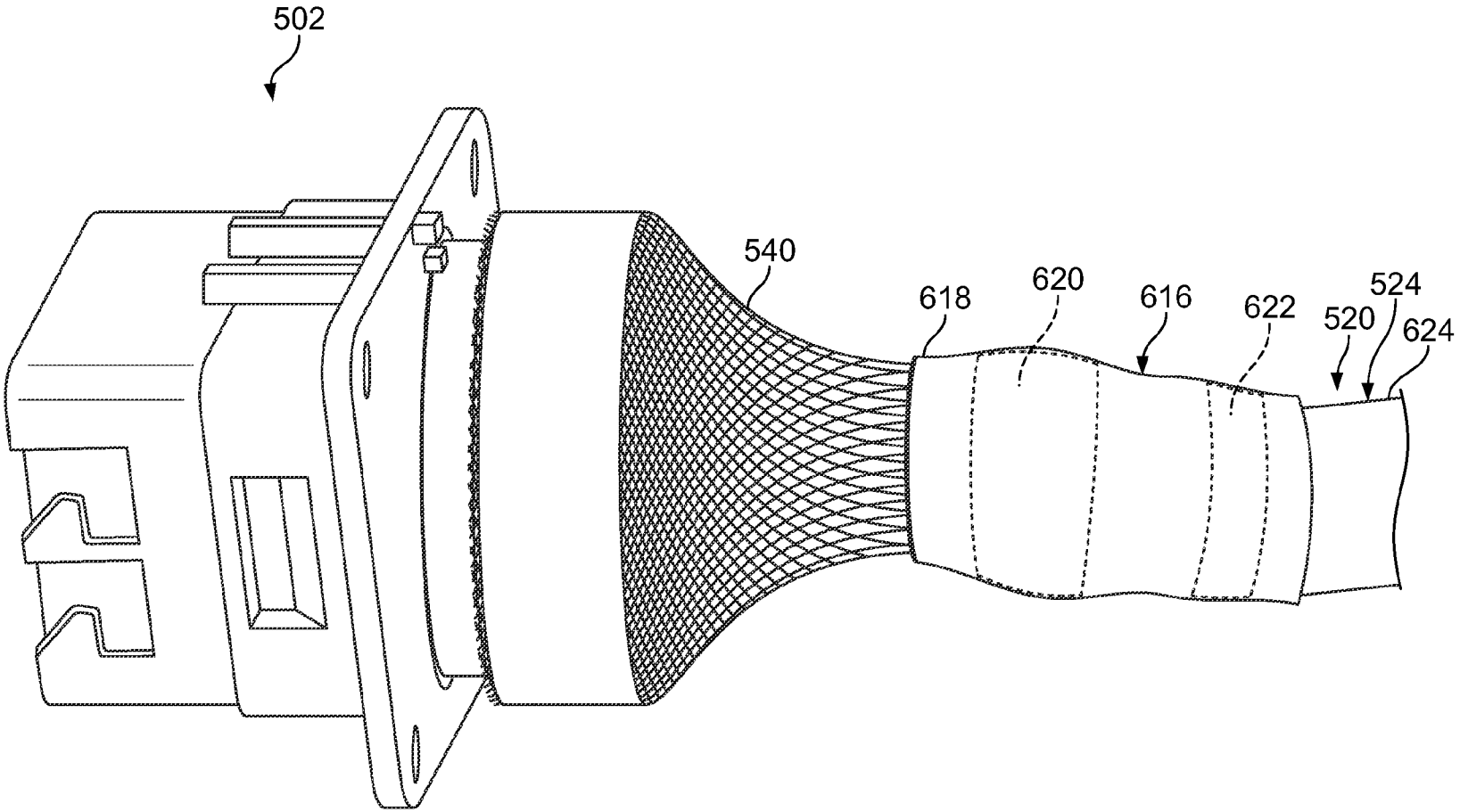
FIG. 13 is a perspective view of the female electrical connector of the connector system shown in FIGS. 7 and 9 illustrating an optional solder sleeve.

FIG. 13 is a perspective view of the female electrical connector 502 and a portion of the cable 520 illustrating an optional solder sleeve 616. A jacket 626 of the cable 520 has been removed from FIG. 13 for clarity. The solder sleeve 616 is configured to engage and electrically connect to the shield 540 of the cable 520, and is configured to engage an insulator (e.g., the insulation 624 or the jacket 626) of the cable 520. More specifically, the solder sleeve 616 includes a dielectric tube 618, a solder ring 620, and an adhesive band 622. The solder ring 620 and the adhesive band 622 extend on an interior surface of the dielectric tube 618. The dielectric tube 618 extends over the shield 540 and the wires 524. In the illustrated embodiment, the adhesive band 622 bonds the dielectric tube 618 to insulation 624 of the wires 524. Alternatively, the dielectric tube 618 extends over the jacket 626 (FIG. 7) of the cable 520 and the adhesive band 622 bonds the dielectric tube 618 to the jacket 626. The solder ring 620 bonds to the shield 540.

Heat may be applied to the solder sleeve 616 to shrink the dielectric tube 618, bond the solder ring 620 to the shield 540, and/or bond the adhesive band 622 to the insulator. The boot 528 (FIGS. 7, 9, and 11) is mounted to the shield fitting 536 such that the boot 528 extends over the solder sleeve 616. The solder sleeve 616 may facilitate sealing the interface between the boot 528 and the insulator of the cable 520 and/or the interface between the boot 528 and the shield 540. Although only shown for use with the female electrical connector 502, the solder sleeve 616 may additionally or alternatively be used with the male connector 504.

The embodiments described and/or illustrated herein may provide an electrical connector having a reduced size, weight, bulk, complexity, and/or the like as compared with at least some known electrical connectors. For example, the embodiments described and/or illustrated herein may eliminate a backshell that is an intermediate component between a housing of the electrical connector and the shield of a cable. In other words, the embodiments described and/or illustrated herein may provide an electrical connector that does not include a backshell.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for terminating a cable, the electrical connector comprising:

an electrical contact configured to be terminated to an end of a wire of the cable; and a housing having a dielectric member and an electrically conductive material extending on the dielectric member, the electrical contact being held by the housing, the housing extending from a mating end to a cable end, the housing being configured to mate with a mating connector at the mating end, the cable end comprising a shield fitting that is configured to hold an end of a shield of the cable such that the electrically conductive material of the housing is engaged with, and electrically connected to, the shield, wherein the electrically conductive material of the housing is a coating that coats the dielectric member.

2. The electrical connector of claim 1, wherein the shield fitting comprises a base and a flange extending radially outward from the base, the shield fitting being configured to hold the end of the shield of the cable such that the shield extends over the flange.

3. The electrical connector of claim 1, further comprising a boot configured to be mounted to the shield fitting, wherein the shield fitting comprises a base and first and second flanges extending radially outward from the base, the first and second flanges being spaced apart along a length of the shield fitting such that a groove is defined between the first and second flanges, the shield fitting being configured to hold the end of the shield such that the shield extends over the first flange and into the groove, the boot being configured to be mounted to the shield fitting such that the boot extends over the end of the shield and over the second flange.

4. The electrical connector of claim 1, further comprising a clamp, wherein the shield fitting comprises a base and a flange extending radially outward from the base, the shield fitting being configured to hold the end of the shield of the cable such that the shield extends over the flange, the clamp being configured to mechanically press the end of the shield to the shield fitting.

5. The electrical connector of claim 1, wherein the shield fitting of the cable end of the housing comprises an exterior surface, the shield fitting being configured to hold the shield of the cable by receiving the shield over the exterior surface such that an inner surface of the shield is engaged with the exterior surface, wherein the exterior surface of the shield fitting includes an outer profile having a circular shape.

6. The electrical connector of claim 1, further comprising a boot configured to be mounted to the shield fitting of the cable end of the housing, the shield fitting comprising a base and a flange extending radially outward from the base, the boot being configured to be mounted to the shield fitting such that the boot extends over the end of the shield of the cable and extends over the flange of the shield fitting.

7. The electrical connector of claim 1, further comprising a boot configured to be mounted to the shield fitting of the cable end of the housing, the shield fitting comprising a base and a flange extending radially outward from the base, the boot comprising a flange, the boot being configured to be mounted to the shield fitting such that the boot extends over the flange of the shield fitting and the flange of the boot engages the flange of the shield fitting.

8. The electrical connector of claim 1, wherein the electrical connector does not include a backshell that is an intermediate component between the housing and the shield.

9. An electrical connector for terminating a cable, the electrical connector comprising:

an electrical contact configured to be terminated to an end of a wire of the cable;

a housing having a dielectric member and an electrically conductive material extending on the dielectric member, the electrical contact being held by the housing, the housing extending from a mating end to a cable end, the housing being configured to mate with a mating connector at the mating end, the cable end comprising a shield fitting that is configured to hold an end of a shield of the cable such that the electrically conductive material of the housing is engaged with, and electrically connected to, the shield; and further comprising a boot and a solder sleeve, the solder sleeve being configured to engage and electrically connect to the shield of the cable, the solder sleeve being configured to engage an insulator of the cable, the boot being configured to be mounted to the shield fitting such that the boot extends over the solder sleeve.

10. An electrical connector comprising:

a cable having a wire and a shield providing electrical shielding around the wire;

an electrical contact configured to be terminated to an end of the wire of the cable; and a housing having a dielectric member and an electrically conductive material extending on the dielectric member, the electrical contact being held by the housing, the housing extending from a mating end to a cable end, the housing being configured to mate with a mating connector at the mating end, the cable end comprising a shield fitting that holds an end of the shield of the cable such that the shield is engaged with and electrically connected to the electrically conductive material of the housing, wherein the shield fitting comprises a base and a flange extending radially outward from the base, the shield fitting holding the end of the shield of the cable such that the shield extends over the flange.

11. The electrical connector of claim 10, further comprising a boot mounted to the shield fitting, wherein the flange of the shield fitting is a first flange of the shield fitting and the shield fitting further comprises a second flange extending radially outward from the base, the first and second flanges being spaced apart along a length of the shield fitting such that a groove is defined between the first and second flanges, the shield fitting holding the end of the shield such that the shield extends over the first flange and into the groove, the boot being mounted to the shield fitting such that the boot extends over the end of the shield and over the second flange.

12. The electrical connector of claim 10, wherein the electrical connector does not include a backshell.

13. The electrical connector of claim 10, wherein the electrically conductive material of the housing is a coating that coats the dielectric member.

14. The electrical connector of claim 10, further comprising a clamp that mechanically presses the end of the shield to the shield fitting.

15. The electrical connector of claim 10, wherein the shield fitting of the cable end of the housing comprises an exterior surface, the shield of the cable being received over the exterior surface such that an inner surface of the shield is engaged with the exterior surface, wherein the exterior surface of the shield fitting includes an outer profile having a circular shape.

16. The electrical connector of claim 10, further comprising a boot mounted to the shield fitting of the cable end of the housing, the boot extending over the end of the shield of the cable and extending over the flange of the shield fitting.

17. An electrical connector for terminating a cable, the electrical connector comprising:

an electrical contact configured to be terminated to an end of a wire of the cable;

a housing having a dielectric member and an electrically conductive material extending on the dielectric member, the electrical contact being held by the housing, the housing extending from a mating end to a cable end, the housing being configured to mate with a mating connector at the mating end, the cable end comprising a shield fitting having a base and first and second flanges extending radially outward from the base, the first and second flanges being spaced apart along a length of the shield fitting such that a groove is defined between the first and second flanges, the shield fitting being configured to hold an end of the shield of the cable such that the shield extends over the first flange and into the groove and such that the electrically conductive material of the housing is engaged with, and electrically connected to, the shield; and a boot configured to be mounted to the shield fitting such that the boot extends over the end of the shield and over the second flange.

18. The electrical connector of claim 17, wherein the boot comprises a flange, the boot being configured to be mounted to the shield fitting such that the flange of the boot engages the second flange of the shield fitting.

* * * * *